US006886725B2

(12) United States Patent
Lowe et al.

(10) Patent No.: US 6,886,725 B2
(45) Date of Patent: May 3, 2005

(54) GUN HOLSTER

(75) Inventors: Michael V. Lowe, Boise, ID (US); Anthony J. Senn, Boise, ID (US)

(73) Assignee: Iron Sheath LLC, Boise, ID (US)

( * ) Notice: Subject to any disclaimer, the term of this patent is extended or adjusted under 35 U.S.C. 154(b) by 163 days.

(21) Appl. No.: 09/816,764

(22) Filed: Mar. 23, 2001

(65) Prior Publication Data

US 2002/0134803 A1 Sep. 26, 2002

(51) Int. Cl.[7] ..... F41C 32/02
(52) U.S. Cl. ..... 224/243; 224/911; 224/198
(58) Field of Search ..... 224/243, 244, 224/265, 242, 911–913, 192, 193, 198, 245; 42/70.01, 70.06–70.08, 70.11; 211/64

(56) References Cited

U.S. PATENT DOCUMENTS

| | | | | |
|---|---|---|---|---|
| 1,842,936 A | * | 1/1932 | Ferdinand | 224/243 |
| 4,318,503 A | | 3/1982 | Capano | 224/244 |
| 5,419,474 A | | 5/1995 | Marx et al. | 224/244 |
| 5,518,155 A | * | 5/1996 | Gallagher | 224/242 |
| 5,570,830 A | | 11/1996 | Nichols | 224/676 |
| 5,573,157 A | | 11/1996 | Mauriello et al. | 224/244 |
| 5,630,535 A | | 5/1997 | Valenti | 224/271 |
| 5,810,221 A | | 9/1998 | Beletsky et al. | 224/244 |
| 5,855,305 A | | 1/1999 | Nichols | 224/244 |
| 5,918,784 A | | 7/1999 | Serpa | 224/244 |
| 5,944,239 A | | 8/1999 | Rogers et al. | 224/193 |
| 6,085,951 A | | 7/2000 | Beletsky et al. | 224/243 |
| 6,112,962 A | | 9/2000 | Matthews | 224/243 |

OTHER PUBLICATIONS

Michaels of Oregon Catalog, pp. 2–7.
Galls Catalog, pp. 183–195.
Affidavit of Michael V. Lowe with Exhibits A Through E.

* cited by examiner

*Primary Examiner*—Lien Ngo
(74) *Attorney, Agent, or Firm*—Robert L. Shaver; Dykas, Shaver & Nipper

(57) ABSTRACT

A security holster for use with a handgun. A locking device secures engages a feature of the handgun, and retains it in the holster until released by the user. The security holster provides for one handed insertion and withdrawal of a handgun, and prevents unauthorized removal of the handgun. An audible indication of insertion and locking is provided by the locking mechanism.

45 Claims, 10 Drawing Sheets

GUN HOLSTER

BACKGROUND OF THE INVENTION

1. Field of the Invention

The present invention generally relates to handgun holsters, and more particularly relates to holsters which provide security against unauthorized withdrawal of a handgun.

2. Background Information

Police and security officers and military personnel in a number of situations must be ready to withdraw and use a handgun in the line of duty at a moment's notice. In an emergency situation, withdrawing the handgun must be done in a completely natural and unobstructed manner, so that it can be withdrawn as quickly as possible. The officer's life may depend on the speed with which they can withdraw the handgun. However, after the handgun is withdrawn, the situation may dictate other options or needs, requiring the officer to reholster the handgun just as quickly. Current holsters do not meet this demand without some continued manipulation of security straps, before the officer knows or has confidence that the weapon is secure. In this type of situation, the officer needs to be able to holster his handgun with one hand, without looking at the holster and while maintaining eye contact with the suspect. During holstering, an audible click and a tactile sensation indicating that the handgun is secured in the holster would be preferable.

The problem comes when the suspect becomes an assailant, and attacks the officer and tries to gain access to his weapon. When this situation develops, it is of utmost importance for the officer to maintain control of his handgun, and that the assailant does not get access to the handgun. Many holsters have been designed to accomplish this purpose, in a number of different manners. However, they all suffer a number of drawbacks. Some require two hands to release and secure the handgun. This is unacceptable. Some of them secure the handgun with a device which can be difficult to release in a fast draw situation, and therefore is a dangerous security mechanism. Some holsters secure the weapon in place from bouncing out of the holster, but are not designed to withstand the attack of an assailant, and would allow the gun to be taken from the officer by an assailant. Some holsters use electronic devices for fingerprint recognition, and run the risk of malfunctioning or having a dead battery. Some holsters require the user to tilt or rock the handgun, or twist it before it can be released from the handgun. Such a maneuver must be practiced frequently in order to ensure that the wearer can perform it without mistake in an emergency situation. All of these methods of securing a handgun are problematic, and an improved security holster is needed which solves these problems.

For these reasons, it is an object of the invention to provide a security holster for a handgun which allows a handgun to be quickly inserted or withdrawn with one hand, without looking at the holster, and which secures the holster to the officer without undue manipulation of straps or the handgun. It is a further goal of the invention that the security holster not allow an assailant to withdraw the handgun against the will of the officer. It is a further object of the invention to provide a handgun securing holster which is easily released by a natural and fluid motion of the officer. It is a further object of the invention to provide a security holster which has an audible click or sound which indicates to the user that the handgun is secured in the holster. Another object of the invention is to provide a security holster with a mechanism which allows the holster to withstand severe force without releasing the handgun, until the releasing mechanism is activated.

SUMMARY OF THE INVENTION

These and other objects of the invention are accomplished by the security holster of the invention. The security holster is designed to be used with a handgun and to be mounted on a user's belt or concealed carry harness, or other mounting positions. The holster has an inner and outer side wall which together define an interior cavity into which the handgun is placed. There is an open top portion of the holster which is designed to receive the handgun and from which the handgun is removed.

The security holster includes a locking means which is designed to engage a feature of the handgun, with an audible indication alerting the user that the handgun has been locked in place. The locking means interacts with a handgun feature when the handgun is placed in the inner cavity of the security holster. The features with which the locking means can interact can include the ejection port of a semi-automatic pistol, the trigger guard of a revolver or semi-automatic handgun, the back of the slide of a semi-automatic pistol, or other features, depending on the specific handgun for which the security holster is fitted. The locking means engages the handgun feature in order to prevent the withdrawal of the handgun without releasing the locking means.

The device also includes a releasing means which is positioned adjacent to the trigger and trigger guard of the handgun. This releasing means is designed so that the user may activate and thereby release the locking means by flexure of the user's finger, such as an index finger. By basing the release of the locking means on flexure of the user's finger, the design is made difficult to circumvent by an assailant reaching into the holster with his finger and releasing the locking means. By requiring flexure of the user's finger to release the locking means, it is almost impossible for an assailant from the front being able to reach in and release the handgun. The device also includes a finger tube built into the side wall of the holster, into which the user inserts a finger for activating the release means. The security holster is configured for one handed insertion of a handgun. When the handgun is fully inserted and the locking means is engaged, the user is notified of this by an audible sound or click upon locking. The handgun is retained until the locking means is released by the releasing means, which is activated by the user depressing the releasing means by flexure of a finger, usually the index finger.

In one embodiment of the invention, the locking means is a generally rectangular block which engages the ejection port of a semi-automatic pistol. The locking means in this embodiment is a locking tab which is attached to a metal plate, which is itself attached to the holster. The metal plate is hinged, with the plate on one side of the hinge being rigidly attached to the holster, and the plate on the other side of the hinge being free to rotate back and forth. The hinged plate is referred to as the spring assembly. The part of the spring assembly mounted to the holster body is called the fixed plate. Attached to the fixed plate is a first arm on which the locking tab is mounted. The locking tab is configured to allow the unobstructed entry of the handgun into the holster, to press against the slide of a handgun as the handgun is inserted into the holster, and to drop into place in the ejection port of a handgun when the handgun is fully inserted into the holster. To accomplish this, the locking tab has a sloping face which faces the open end of the holster, and allows entry and passage of the handgun. The locking tab has a notch in the side which faces the open end of the holster, which locks against an edge of the holster at a locking tab passage which extends through the holster body.

A second arm of the spring plate assembly is attached to the first arm. The second arm includes a release tab which is directly and operationally connected to the first arm and the locking tab. The release tab is configured to rest adjacent the trigger guard of the handgun when the handgun is fully inserted into the holster. The release tab also covers the trigger, so that depressing the release tab does not activate the trigger. This feature prevents the handgun from being accidentally fired when it is in the security holster. Activation of the release tab is accomplished by the user flexing a finger, generally an index finger, when it is inserted into the holster adjacent the release tab.

The security holster of the invention thus provides for one handed insertion of the handgun. During insertion of the handgun into the security holster, the locking tab admits the handgun and engages a feature of the handgun for retention of the handgun unless and until the locking tab is disengaged by the user pressing the release tab. The release tab is pressed by the natural flexure of the user's finger. In this way, the handgun can be removed from the security holster without looking at it, and by user using only one hand. Features which can be added to enhance the embodiment of the security holster described above can include the locking tab being configured to make an audible click or sound when it engages with the handgun feature. The handgun feature can be the ejection port, a trigger guard, the back of the handle, or any other appropriate feature of the handgun.

The spring plate assembly of the invention can take several different forms. In one embodiment of the security holster, the spring plate assembly includes a piano hinge between the fixed plate and the first and second arm. In this embodiment, the hinge between the fix plate and the first and second arm includes a biasing device such as a spring.

In another version of the security holster, the spring plate assembly includes a torsion spring, which connects the fixed plate with the first and second arm. One feature of the holster of the invention can include the holster being made of a rigid material such as a sturdy plastic. Other materials could also be suitable such as leather or metal, or combinations of these materials. The locking tab can be configured so that the edge of the locking tab which faces toward the open end of the holster is sloping, which enables the handgun to slide under it upon insertion. The side of the locking tab which faces toward the barrel end of the holster is also notched, so that when the locking tab drops into the handgun feature such as the ejection port, the notch will engage the handgun feature and prevent the handgun from being withdrawn from the security holster past the locking tab.

One embodiment of the security holster includes a locking tab which is connected to the spring plate assembly by a floating connection, which allows the locking tab a certain limited freedom of motion in it's attachment to the spring plate assembly. This floating attachment allows force applied to the handgun to withdraw it to be transferred through the locking tab to the security holster. In this way, the security holster is much stronger in resisting this unauthorized withdrawal of a handgun than if the force of the withdrawal were applied to the spring plate assembly alone, through the spring plate assembly's connection to the locking tab.

Another embodiment of the security holster utilizes one or more springs which are biased upon insertion of a handgun. After the handgun is fully inserted and then released, the springs press the handgun toward the entry end of the handgun, thereby engaging the locking notch of the locking tab against the holster body at the locking tab passage. In this configuration, to release and remove the handgun, the user first presses the handgun deeper into the security holster a small amount, then depresses the release tab.

Still other objects and advantages of the present invention will become readily apparent to those skilled in this art from the following detailed description wherein we have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1A:
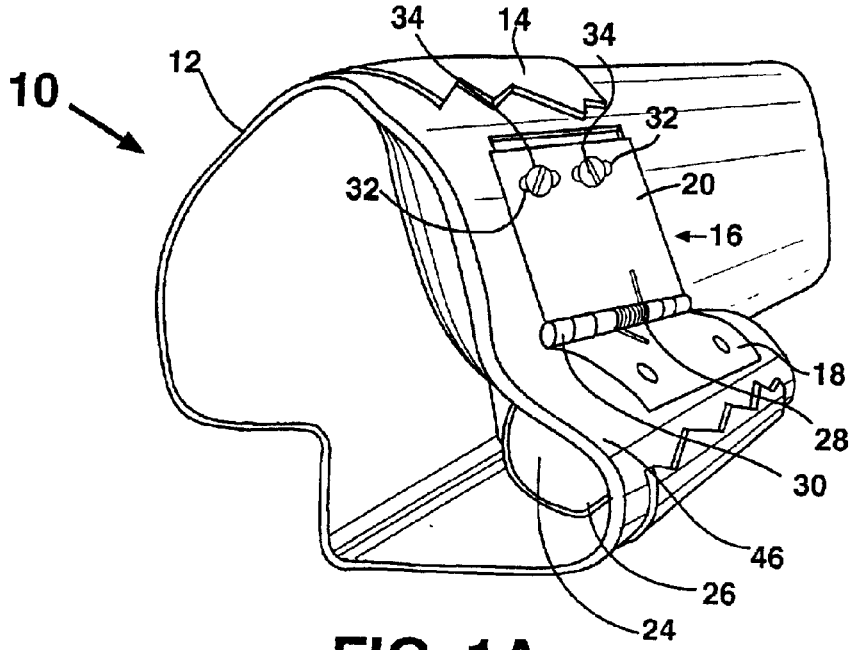
FIG. 1A is a perspective cutaway view of the security holster.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 1B:
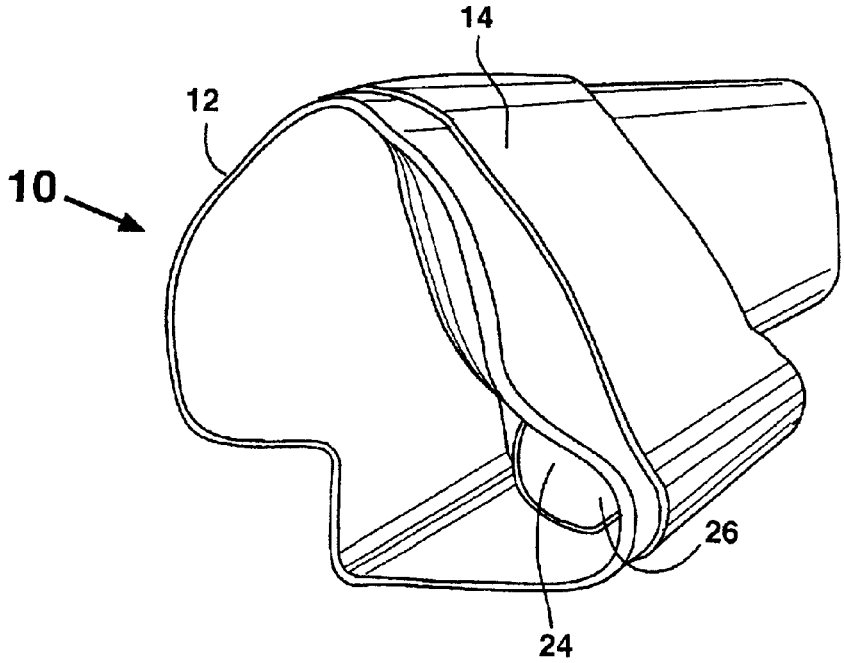
FIG. 1B is a perspective view of the security holster.
Figure 2:
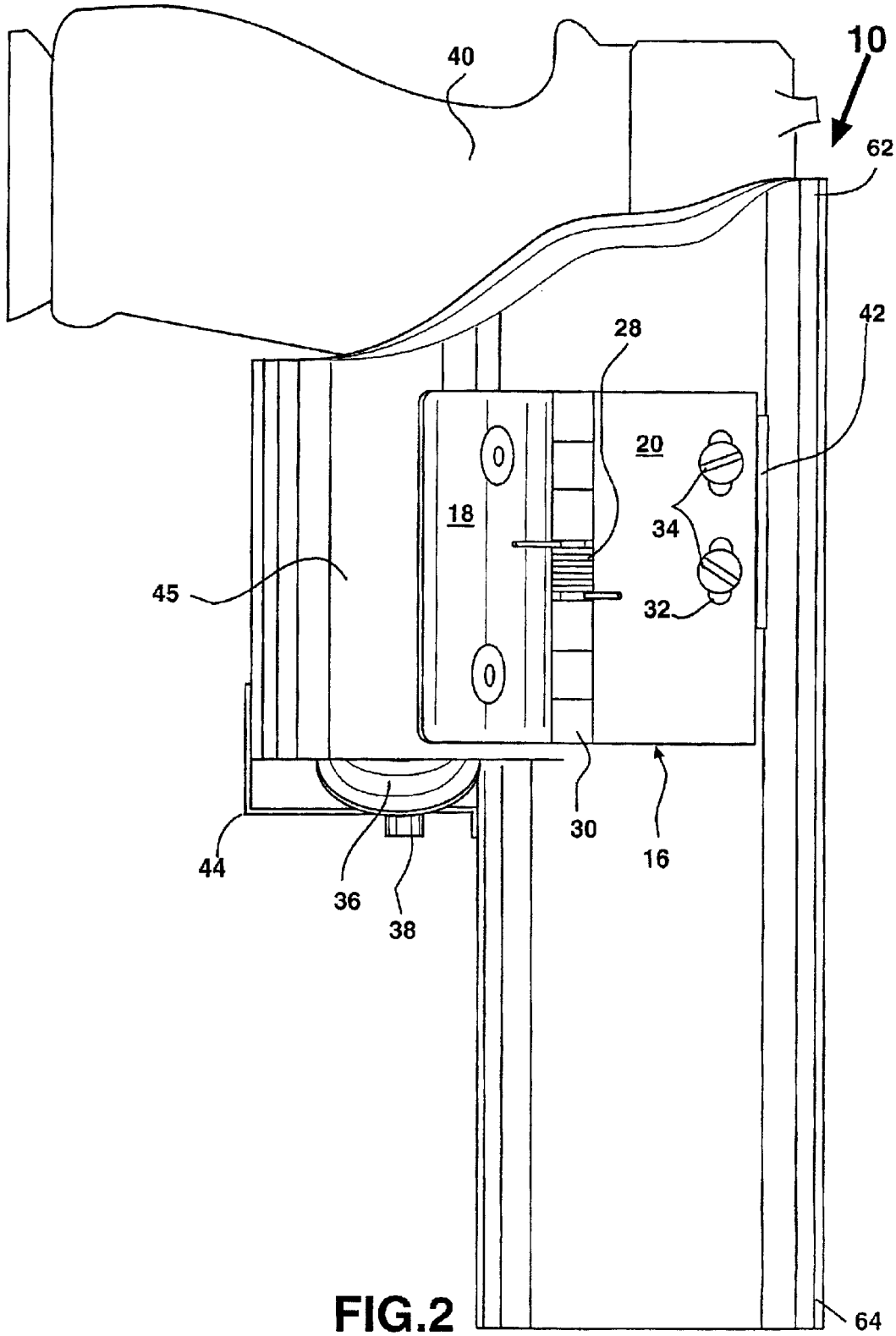
FIG. 2 is a side view of the security holster with a handgun inserted into the security holster.

Several preferred embodiments and features of the security holster are shown in FIGS. 1 through 8. Preferably, the security holster is made a tough and durable plastic such as Kydex (Mfg. By Kleerdex Company). A thickness of ⅛ inch of this material has been found to be suitable for making the security holster. Other materials or thicknesses of materials which have similar characteristics of rigidity, strength, and weight would also be suitable. This might include metal such as aluminum or steel, other types of plastics, or leather. The security holster shown in FIGS. 1A, 1B and 2 show the general configuration of the security holster when used with a handgun 40, and is designated as 10 in the figures. The security holster 10 includes a holster body 12 and a holster outer cover 14. The holster outer cover 14 wraps either fully or partially around the holster body 12, and covers the locking mechanism. FIG. 1 shows the holster outer cover 14 cut away to reveal the locking mechanism of this embodiment.

The locking mechanism of this embodiment is referred to as spring plate assembly 16. Spring plate assembly 16 includes three parts. The first part is a fixed plate 18 which is rigidly and permanently attached to a bulge in the holster body 12. The bulge in the holster body 12 forms a finger tube 46 which is an opening between the handgun and the holster body 12 which allows insertion of a user's index finger. Fixed plate 18 is preferably metal, and Stainless Steel has proven to be a suitable metal for its construction. Opposite fixed plate 18 is a first arm 20 which is rigidly attached to a second arm 24, both of which are attached by a hinge 30 to the fixed plate 18. The second arm 24 includes a release tab 26, which is semicircular in cross section and fitted to receive the index finger of a user, and lies over the trigger and trigger guard of a handgun 40 when it is fully inserted into the security holster 10. The second arm 24 and its components are rigidly attached to the first arm 20. The first arm 20 also includes locking tab mounting slots 32, locking tab mounting screws 34, and a locking tab 22 (which is shown in FIG. 3B. The locking tab 22 is mounted to the first arm 20 so that the screws 34 which secure it allow the locking tab 22 to move back and forth in the locking tab mounting slots 32. The first arm 20 and second arm 24 are attached to the fixed plate 18 by a hinge 30. The hinge 30 includes a spring 28 which presses the first arm 20 against the holster body 12. The spring 28 also pushes the second arm 24 away from the handgun and towards the finger tube 46. The locking tab 22 passes through a locking tab passage 42 in the holster body 12, in order to engage the ejection port of the handgun 40.

Figure 3A:
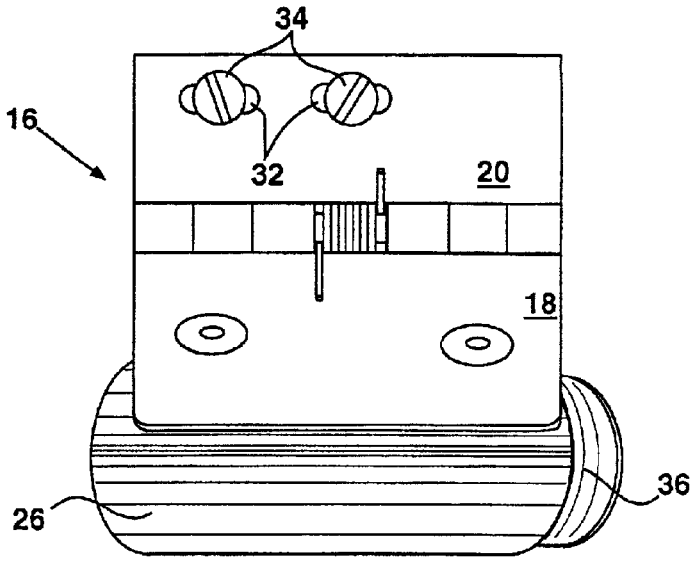
FIG. 3A is a side view of the right side of the spring plate assembly.
Figure 3B:
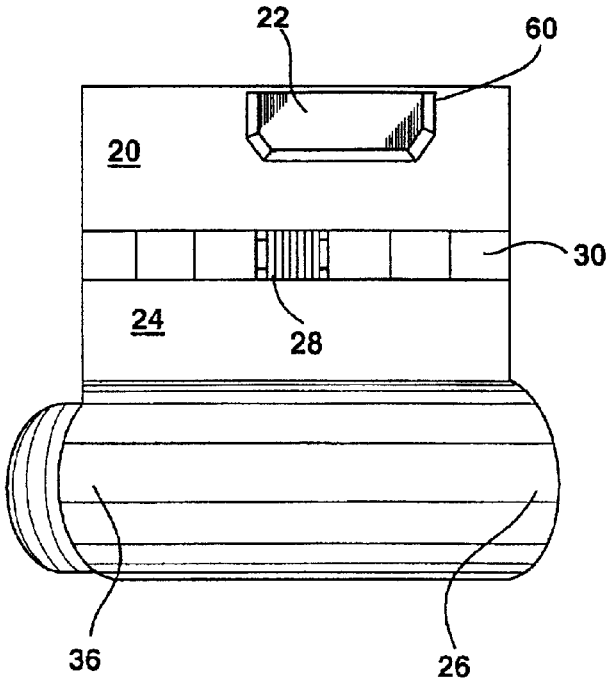
FIG. 3B is a side view showing the left side of the spring plate assembly.

FIGS. 3A and 3B show a detailed view of the spring plate assembly 16. These views are of the right and left side of the spring plate assembly 16, with the holster body 12 removed. As seen in FIG. 3A, the release tab 26 is semicircular in cross section and curved to easily admit a user's index finger. On one end of release tab 26 is a fingertip flare 36 which is also curved and serves to help the user position his finger on the release tab 26. As shown in FIG. 3A, the locking tab mounting slots 32 allow the locking tab mounting screws 34 and the locking tab 22 to move back and forth in the locking tab mounting slots 32. As shown in FIG. 3B, the locking tab 22 has several angled faces. An engagement edge 60 faces towards an entry end 62 of the security holster 10.

Figure 4A:
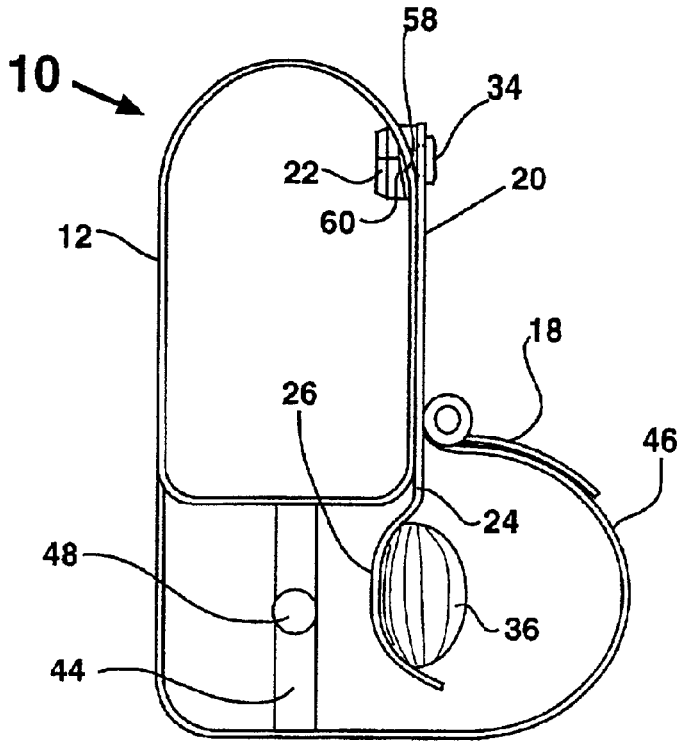
FIG. 4A is a rear view of the security holster showing the locking tab in the locked position.
Figure 4B:
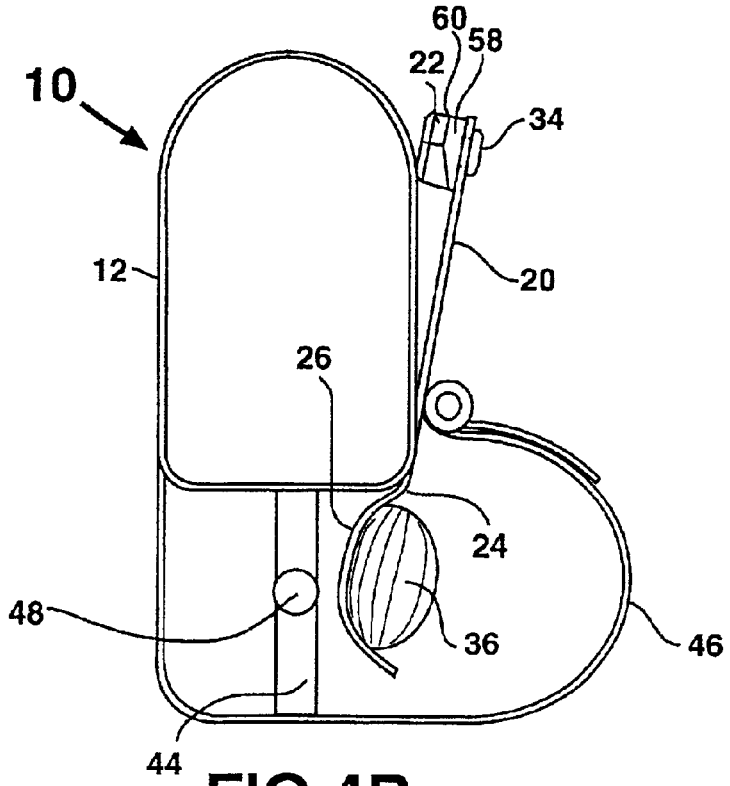
FIG. 4B is a rear view of the security holster showing the locking tab in a releasing position.

FIGS. 4A and 4B are views of the security holster 10 looking from the entry end 62 toward the barrel end 64. They show the spring plate assembly 16 in two positions. FIG. 4A shows the spring plate assembly with the first arm 20 lowered into a locking position. If a handgun 40 were in the security holster 10 in this position, the locking tab 22 would be engaged with the ejection port of the handgun to secure the handgun 40 in the security holster 10. FIG. 4B shows the first arm 20 raised away from the holster body 12 into a release position. When the fixed arm 20 moves in relation to the holster body 12, the second arm 24 also moves, since it is rigidly attached to the first arm 20. In this position, the locking tab 22 is disengaged from the ejection port of the handgun 40, and the handgun 40 could be withdrawn from the security holster 10.

Figure 5:
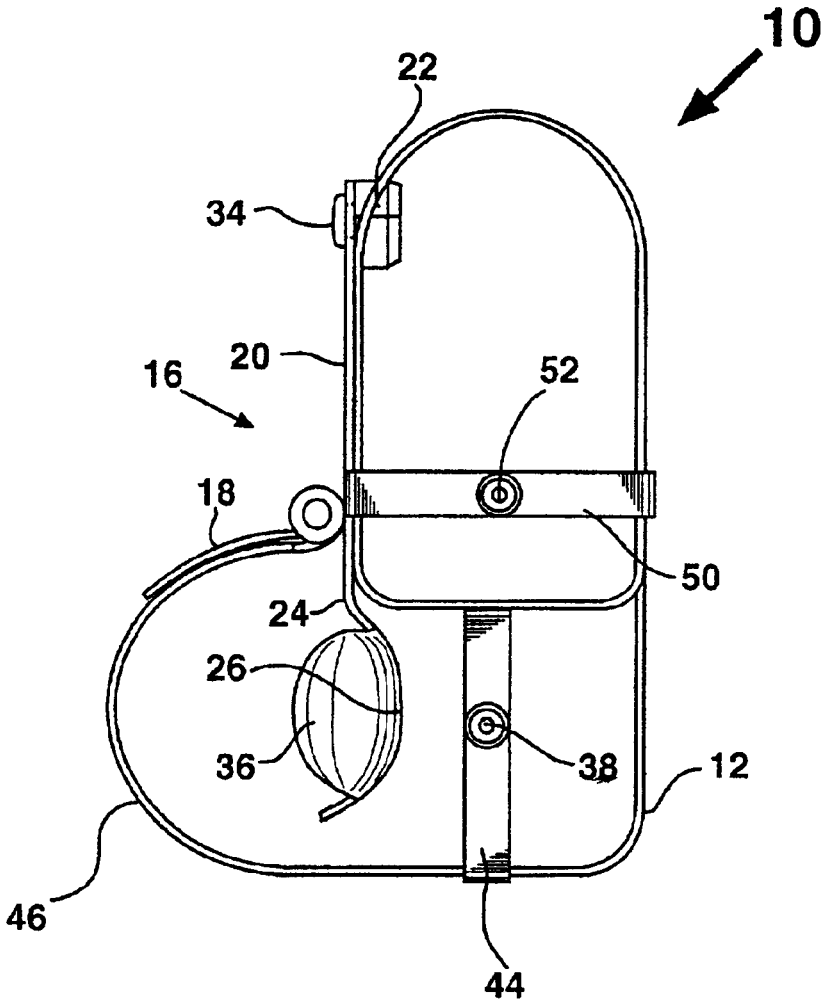
FIG. 5 is a front view of the security holster.

FIG. 5 is a front view of the security holster 10, looking from the barrel end 64 towards the entry end 62. This view shows a first arm 20 in a locking position. It also shows a trigger guard spring mount 38 and a slide spring mount 52. These are two alternative positions of a spring which extends backward from the spring bracket 44 or the slide spring bracket 50, with a short coil spring which presses against the handgun 40. In the preferred embodiment, this coil spring is approximately ¼ inch in diameter, and extends approximately ¾ inches toward the entry end 62 of the security holster 10. When a handgun 40 is inserted into the security holster 10, the spring is depressed until its length is about ⅜ inches. Two positions are shown for a spring bracket and a spring. The reason for this is that some handguns 40 can be equipped with devices such as flashlights or laser sights which mount to the front of a trigger guard of a handgun. With such a device, the trigger guard spring bracket 44 would be dispensed with and only the slide spring bracket 50 and the slide spring mount 52 would be utilized. These springs serve as a rebounding device, and other rebounding devices could also be utilized. A compressible material such as foam would serve as such a rebounding device.

Figure 6A:
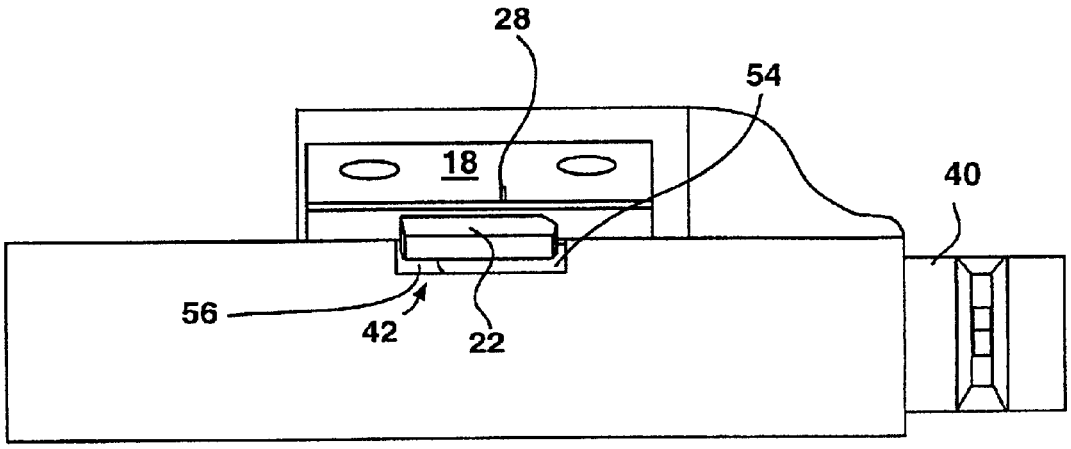
FIG. 6A is a top view of the security holster with a handgun partially inserted.
Figure 6B:
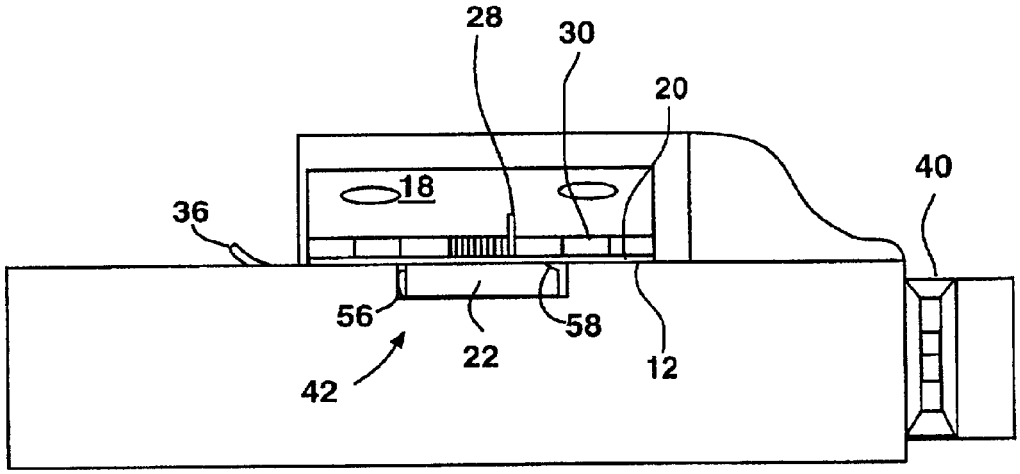
FIG. 6B is a top view of the security holster with a handgun fully inserted, but not released.
Figure 6C:
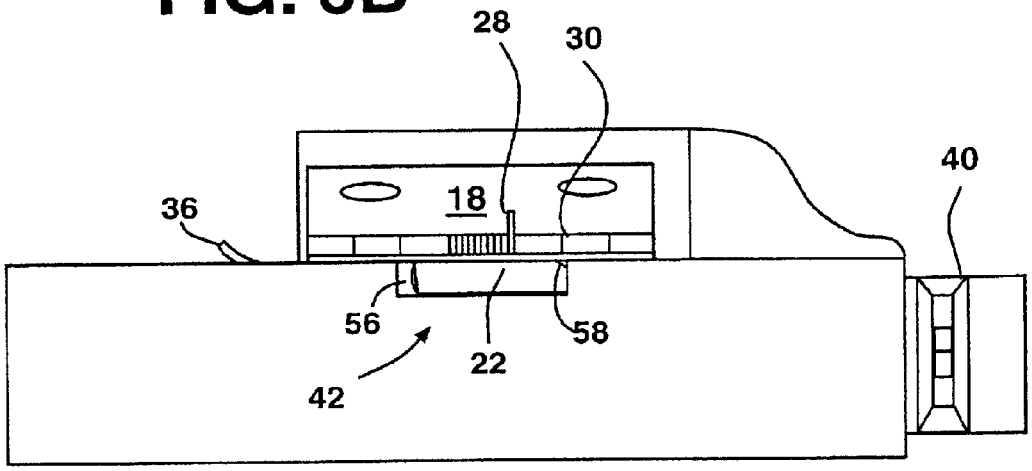
FIG. 6C is a top view of the security holster with a handgun fully inserted, not released, and locking tab is shown engaged with holster body.
Figure 8:
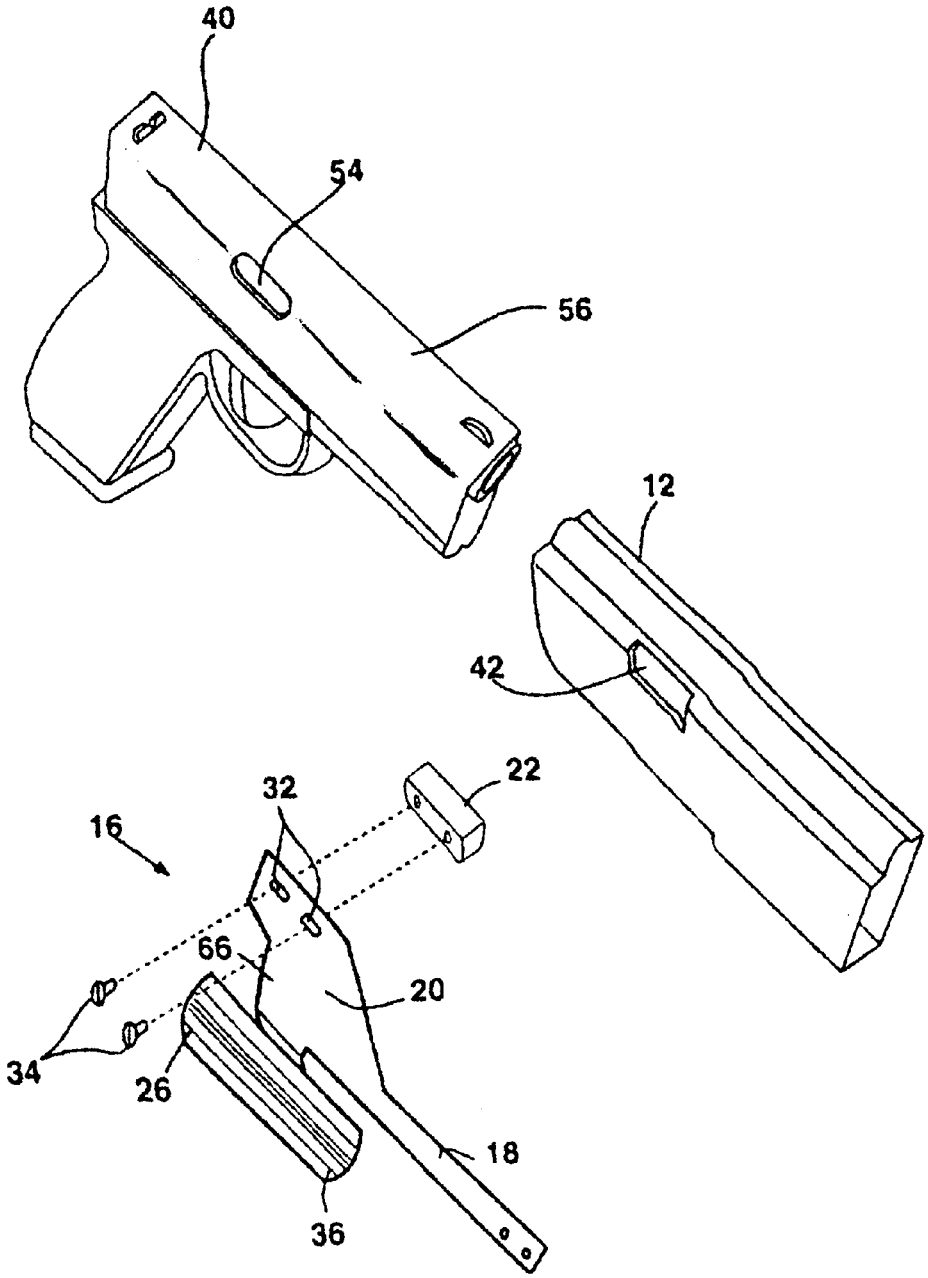
FIG. 8 is an exploded view of the security holster with torsion spring and its parts.

FIGS. 6A, 6B and 6C illustrate the interaction of the security holster 10, the locking tab 22, and the handgun ejection port 54 of the handgun 40. When seen from the top view, the security holster 10 has a locking tab passage 42, which is adjacent the locking tab 22 and allows the locking tab 22 to pass through the wall of the security body 12. The handgun 40 includes a handgun slide 56 and a handgun ejection port 54, which permits a spent cartridge (not shown) to pass through the handgun ejection port 54 and through the handgun slide 56. FIG. 8 shows these handgun parts to advantage. As a handgun 40 is inserted into the security holster 10, the handgun slide 56 lifts the locking tab 22, and slides past it as it enters the security holster 10. FIG. 6A shows a portion of the handgun slide 56 lifting the locking tab 22. The handgun ejection port 54 is visible in the locking tab passage 42 of the security holster 10.

As shown in FIG. 6B, when the handgun 40 has been fully inserted into the security holster 10, the locking tab 22 is past the handgun slide 56, and can drop into place in the handgun ejection port 54. When this happens, the first arm 20 falls into place against the side of the holster body 12 as shown in FIG. 6B. The locking tab 22 includes an engagement notch 58 which is adjacent the interface of the locking tab 22 and the first arm 20. At this point, the handgun 40 cannot be removed without first depressing the release tab 26. If the release tab 26 were depressed, the locking tab 22 would move into the position shown in FIG. 6A, and the handgun ejection port 54 would not be engaged, and the handgun 40 could be removed.

In one preferred embodiment of the security holster 10 of the invention, the security holster 10 is provided with one or more springs. A spring can be mounted on the trigger guard spring bracket 44, and/or could be mounted on the slide spring bracket 50 which was shown in FIG. 5. In the embodiment which utilizes one or more springs, once the handgun had been fully inserted as shown in FIG. 6B, the user could release the handgun 40, and the spring would press the handgun back in the security holster 10, until the engagement notch 58 of the locking tab 22 engaged with the holster body 12 which was exposed in the locking tab passage 42. This position is shown in FIG. 6C. When springs are used as described above, the user would need to compress the springs a small amount by pressing down on the handgun 40, in order to allow release of the locking tab 22 and thus the handgun by pressing the release tab 26. This creates a secondary locking system by physically linking the locking tab 22 to the holster body 12. When this happens, if force is applied to the handgun to withdraw it without first releasing the locking tab 22, the force is transmitted to the holster body, and the first arm 20 does not bear this force without support.

Figure 7:
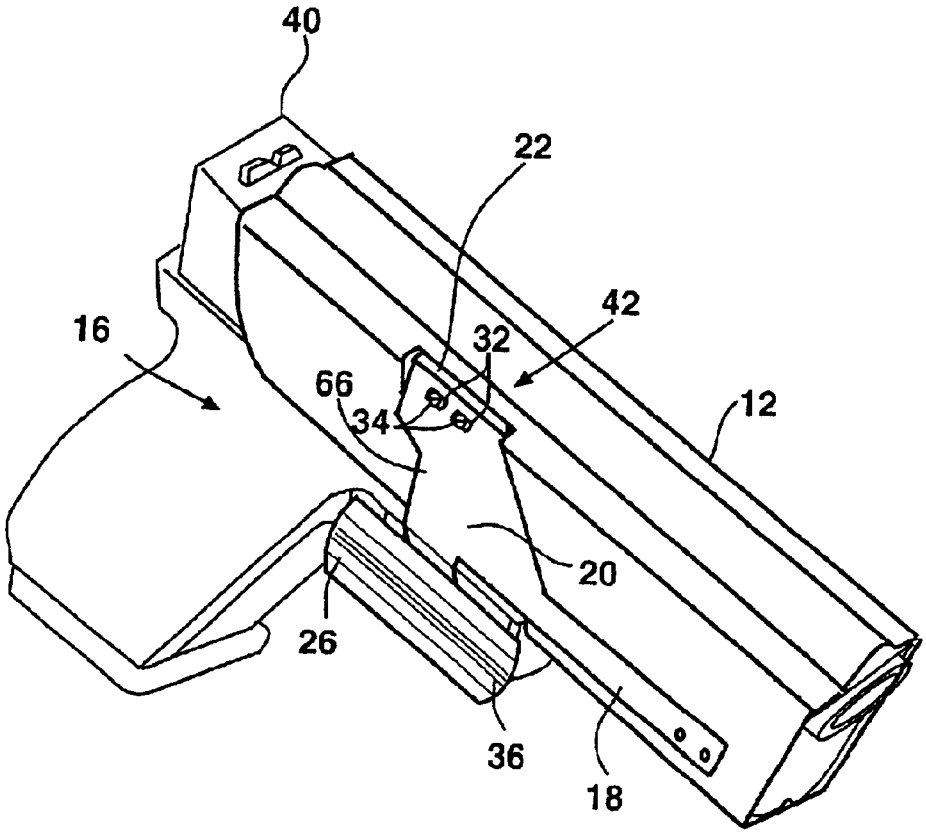
FIG. 7 is a perspective view of the security holster which utilizes a torsion spring.

A second preferred embodiment of the invention is shown in FIGS. 7 and 8, in which the spring plate assembly is a T shaped torsion spring 66. Depressing a second arm 26 of the torsion spring 66 lifts the first arm 20 and its attached locking tab 22 out of the ejection port by 54 of the handgun, to release the handgun 40.

Figure 9:
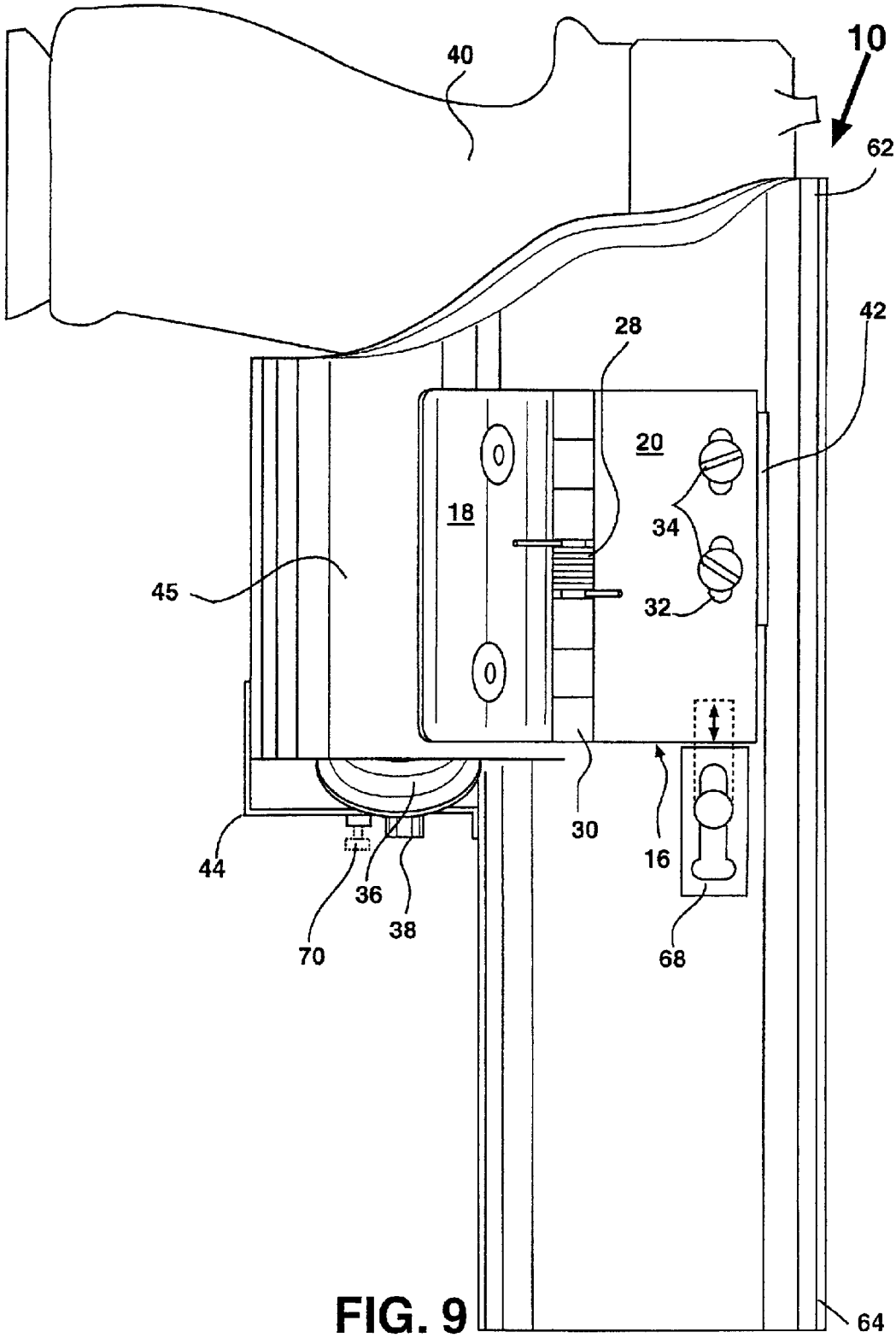
FIG. 9 is a side view of the handgun showing safety lock mechanisms.

FIG. 9 shows the security holster 10 of the invention with a first security lock 68 and a second security lock 70. Each of these security locks allow a user to lock the first and second arm from movement, and thus lock a handgun 40 in the security holster 10, and prevent the release of the locking tab 22. In either security lock, a tab can be moved forward or backward which physically prevents the locking tab 22 from being lifted, and thus prevents the handgun 40 from being released and withdrawn.

Figure 10A:
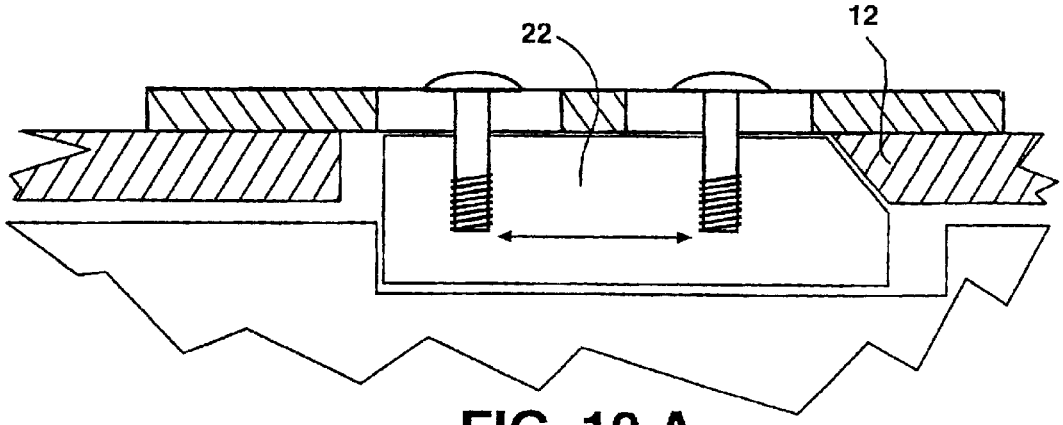
FIG. 10A is an embodiment of the locking tab with a tapered edge.
Figure 10B:
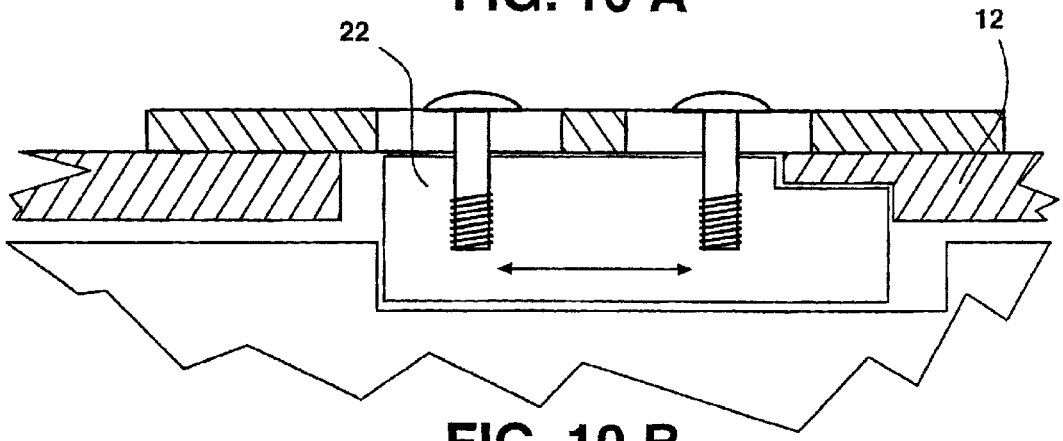
FIG. 10B is an embodiment of the locking tab with a lap joint configuration.
Figure 10C:
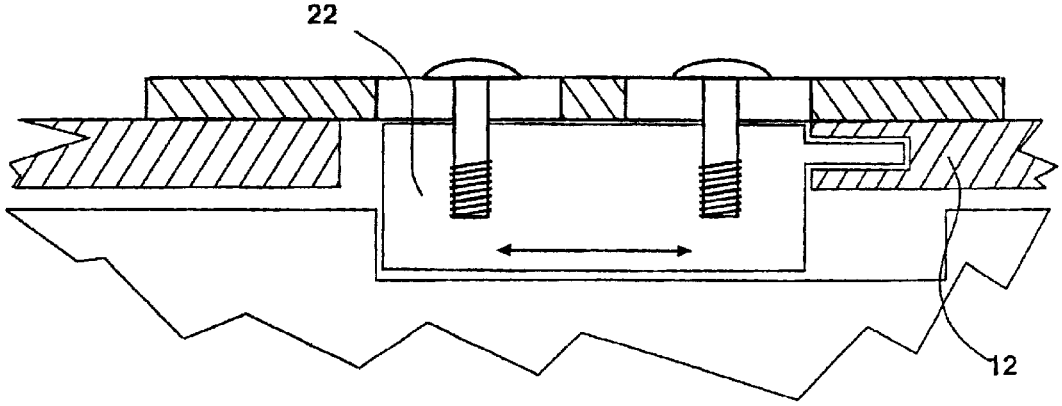
FIG. 10C is an embodiment of the locking tab with a tongue and groove configuration.

FIGS. 10A, 10B, and 10C show three embodiments of the interface between the locking tab 22 and the holster body 12. FIG. 10A shows the locking tab 22 having a sloping surface, FIG. 10B shows a lap joint type interface, and FIG. 10C shows a tongue and groove type connection.

From the foregoing description, it will be apparent that various changes may be made without departing from the spirit and scope of the invention as defined by the following claims. While there is shown and described the present preferred embodiment of the invention, it is to be distinctly understood that this invention is not limited thereto but may be variously embodied to practice within the scope of the following claims.

We claim:

1. A security holster for use with a handgun, the handgun having a trigger guard and trigger, an ejection port, slide, and handle, wherein the holster comprises:

a holster body that includes spaced apart inner and outer substantially rigid sidewalls formed to define an inner cavity and an open top portion for receiving a handgun therein, and for removing a handgun there from, said holster having a long axis parallel with said barrel of said handgun when secured in said holster body;

a locking tab configured to admit said handgun into said security holster body, and upon insertion of said handgun, to engage a feature of said handgun, thereby preventing the withdrawal of said handgun prior to release of said locking tab;

a release tab, for releasing said locking tab which is operationally connected to said locking tab, which is positioned generally adjacent to said trigger guard of said handgun when fully inserted in said holster body, which when activated disengages said locking tab from handgun feature;

a finger tube with an axis generally parallel to said long axis of said holster body, enclosing said release tab, in which a user may insert a finger in order to activate said release tab to release said locking tab from said handgun feature; wherein said security holster provides for one handed insertion of said handgun into said security holster, with said locking tab which admits said handgun during insertion, and which engages said handgun feature for retention of said handgun until said locking tab is disengaged by depression of said release tab.

2. The holster of claim 1 wherein said locking tab is attached to a biased plate attached to said holster, which causes said locking tab to be selectively movable between a first locking position, and a second, releasing position, said first position for retention of said handgun by engagement with a handgun feature, and said second position for release of a handgun by allowing disengagement of said locking tab from said handgun feature.

3. The holster of claim 1 in which said locking tab is configured to engage an ejection port of a semi-automatic handgun.

4. A security holster for use with a handgun, said handgun having a handgun body, a barrel, a trigger guard, a trigger, and a long axis parallel with said barrel, said holster comprising:

a holster body for sliding engagement with said handgun, with a finger tube formed in said holster body alongside said handgun when said handgun is holstered, said finger tube being oriented generally parallel to said long axis of said handgun when said handgun is in said holster, and said finger tube terminating adjacent to said trigger guard of said handgun, when said handgun is holstered in said holster body, and said holster body having a locking tab passage for admitting a locking tab through said holster body and into an enclosed handgun;

a spring plate assembly, which comprises;

a fixed plate mounted on said holster body;

a first arm which includes the locking tab which is configured to extend through said locking tab passage of said holster body and admit said handgun during insertion of said handgun, and engage a feature of said handgun when said handgun is fully inserted, and to retain said handgun unless said locking tab is withdrawn from said handgun feature; and a second arm which is attached to said first arm, which includes a release tab which is operationally connected to said locking tab, and which is activated by flexure of a finger of said user, and which lifts said locking tab from said handgun feature when said release tab is depressed; wherein said security holster provides for one handed insertion of said handgun into said security holster, via said locking tab which admits said handgun during insertion, and which engages a handgun feature for retention of said handgun unless said locking tab is disengaged by depression of said release tab by flexure of said index finger, thereby providing said security holster with one finger release of said handgun, and one handed insertion and withdrawal of said handgun.

5. The security holster of claim 4 in which said locking tab is configured to engage said handgun feature with an audible sound upon engagement of said locking tab with said handgun feature.

6. The security holster of claim 1 in which said locking tab operates with at least one rebounding device, so that when a handgun is pressed into said security holster with a required degree of insertion force, said locking tab is activated to secure said handgun, and said rebounding device urges said handgun toward said the entry end of said holster body against said locking tab.

7. The security holster of claim 6 in which said rebounding device comprises one or more springs attached to said holster body, which press against said handgun when said handgun is pressed into said security holster body.

8. The security holster of claim 4 in which said spring plate assembly is hinged between said fixed plate and said first arm, and includes a biasing means.

9. The security holster of claim 4 in which said spring plate assembly is generally T shaped, with said fixed end forming a base of said T and with said first arm and said second arm forming a first and second arm of said T, with said fixed plate connected to said first and second arm of said T by a torsion spring.

10. The security holster of claim 4 in which said holster body and finger tube are constructed of a rigid material.

11. The security holster of claim 4 in which said finger tube further includes a flared rim for facilitating insertion of said users index finger into said finger tube.

12. The security holster of claim 4 in which said locking tab interacts with an ejection port of a semi-automatic handgun.

13. The security holster of claim 4 in which said security holster includes a handgun entry end and a barrel end, and said locking tab is configured with a sloping first edge which faces toward said barrel end said, with said sloping first edge for engagement with an ejection port.

14. The security holster of claim 13 in which said locking tab is attached to said spring plate assembly by a floating connection, in which said locking tab is allowed a limited freedom of motion in its attachment to said spring plate assembly, so that if said handgun is forcefully withdrawn from said security holster without releasing said locking tab, said locking tab is pulled into engagement with a holster inner sleeve, so that force applied to withdrawing said handgun is transferred to said holster inner sleeve and is not directed to said spring plate assembly.

15. The security holster of claim 4 which further includes one or more security locks which immobilize said release tab.

16. A security holster for use with a handgun, said handgun having a handgun body, a trigger guard, a trigger, and an ejection port, comprising:

a rigid holster body for enclosing a handgun, which is configured to surround said handgun, and which includes a handgun entry end and a barrel end;

a finger tube formed in said holster body, so that when said handgun is holstered in said holster body, said finger tube is alongside and parallel to said handgun body, and said finger tube terminates adjacent to said trigger guard of said handgun, with said holster body having a passage for an ejection port locking device;

a hinged spring plate assembly, with a fixed plate, a first arm, and a second arm, in which said fixed plate is attached to said rigid holster body, and which is joined to said first arm and a second arm with a hinge which includes a spring, and said first arm further includes a locking tab which is configured to pass through said passage in said holster body, and admit said handgun during insertion, and includes a sloping first edge which faces toward said barrel end of said holster for audibly engaging said ejection port, and a notched side which faces toward said handgun entry end of said holster for engaging said holster, in which said locking tab engages an ejection port of said handgun to prevent withdrawal unless released, and said second arm further includes a release tab which is operationally connected to said locking tab, which is activated by flexure of said users index finger, so that depression of said release tab causes lifting of said locking tab and release of said handgun; whereby said security holster provides for one handed insertion of said handgun into said security holster, with audible engagement of said locking tab with said handgun ejection port, and allows release and withdrawal of said handgun by depression of said release tab by flexure of said index finger, thus providing said security holster with one finger release of said handgun, and one handed withdrawal of said handgun.

17. The security holster of claim 16 in which said locking tab is attached to said spring plate assembly by a floating connection, in which said locking tab is allowed a limited freedom of motion in its attachment to said spring plate assembly, so that if said handgun is forcefully withdrawn from said security holster without releasing said locking tab, said locking tab is pulled into engagement with said holster body, so that force applied to withdrawing said handgun is transferred to said holster body and is not directed to said spring plate assembly.

18. The security holster of claim 1 in which said release tab is located in a position to be adjacent to and cover said trigger of said handgun when said handgun is inserted and secured in said holster body, thus preventing depressing of said trigger during handgun withdrawal.

19. The security holster of claim 1 which further includes an audible indication of locking, so that a user does not have to look at said holster to verify that said handgun is secured in said holster body.

20. The security holster of claim 19 in which said audible indication of locking is said locking tab, which is configured to snap into place in said handgun feature with a spring, thus providing an audible indication of locking.

21. The security holster of claim 18 in which said release tab is an elongate tray, semicircular in cross section, providing a curved shape which conforms to a user's finger.

22. The security holster of claim 18 in which said release tab is configured for sliding engagement with a users finger during release of said handgun, so that said release tab may be depressed while said users finger is being withdrawn from said holster body and moving across said release tab, while said handgun is being removed.

23. The security holster of claim 1, in which said release tab is activated by flexion of said user's index finger, for one finger release and straight out withdrawal of said handgun from said holster body.

24. The security holster of claim 1 in which said release tab is configured to interact with a rebounding means, so that a minimum degree of insertion force is required before said release tab can be activated and said handgun ejection port is released from said locking tab.

25. The security holster of claim 1 wherein said finger tube further includes a flared rim for facilitating insertion of said users index finger into said finger tube.

26. A security holster for use with a handgun, the handgun having a handgun body, trigger guard, a trigger, an ejection port, slide, handle, trigger, and trigger guard, wherein the holster comprises:

a holster body that includes spaced apart inner and outer substantially rigid sidewalls formed to define an inner cavity and an open top portion for receiving a handgun therein, and for removing a handgun there from, said holster body including a passage adjacent the handgun ejection port;

a locking tab configured to admit said handgun into said security holster body, and upon insertion of said handgun, to move through said passage into engagement with said ejection port of said handgun until released, thereby preventing the withdrawal of said handgun prior to release of said locking tab;

a release tab, for releasing said locking tab from said ejection port by moving said locking tab in relation to said holster, with said release tab operationally connected to said locking tab, which when depressed disengages said locking tab from said ejection port; wherein said security holster provides for one handed insertion of said handgun into said security holster and release there from, with said locking tab which admits said handgun during insertion, and which moves into engagement with said ejection port for retention of said handgun until said locking tab is moved out of engagement by activation of said release tab.

27. The security holster of claim 26 in which said release tab is located in a position to be adjacent to and cover said trigger of said handgun when said handgun is inserted and secured in said holster body, thus preventing depressing of said trigger during handgun withdrawal.

28. The security holster of claim 26 which further includes an audible indication of locking, so that a user does not have to look at said holster to verify that said handgun is secured in said holster body.

29. The security holster of claim 28 in which said audible indication of locking is said locking tab, which is configured to snap into place in said ejection port by a spring, thus providing an audible indication of locking.

30. The security holster of claim 26 in which said release tab is an elongate tray, semicircular in cross section, for providing a curved shape which conforms to a user's finger.

31. The security holster of claim 30 in which said release tab is configured for sliding engagement with a users finger during release of said handgun, so that said release tab may be depressed while said users finger is being withdrawn from said holster body and moving across said release tab, while said handgun is being removed.

32. The security holster of claim 26, in which said release tab is activated by flexion of said user's index finger, for one finger and one motion release of said handgun from said holster body.

33. The security holster of claim 26 in which said locking tab operates with at least one rebounding device, so that when a handgun is pressed into said security holster with a required degree of insertion force, said locking tab is activated to secure said handgun, and said rebounding device urges said handgun toward said the entry end of said holster body against said locking tab.

34. The security holster of claim 33 in which said rebounding device comprises one or more springs attached to said holster body, which press against said handgun when said handgun is pressed into said security holster body.

35. The security holster of claim 26 in which said release tab is configured to interact with a rebounding device, so that a minimum degree of insertion force is required before said release tab can be activated and said locking tab is release from said handgun ejection port.

36. The security holster of claim 26 which further includes one or more security locks which immobilize said release tab.

37. A security holster for use with a handgun, the handgun having an ejection port, slide, handle, trigger, and trigger guard, wherein the holster comprises:

a holster body that includes spaced apart inner and outer substantially rigid sidewalls formed to define an inner cavity and an open top portion for receiving a handgun therein, and for removing a handgun therefrom, said holster having a long axis parallel with said barrel of said handgun when secured in said holster body;

a locking tab configured to admit said handgun into said security holster body, and upon insertion of said handgun, to move into engagement with said ejection port of said handgun, thereby preventing the withdrawal of said handgun prior to release of said locking tab;

a release tab, for releasing said locking tab, which is operationally connected to said locking tab, which when depressed moves said locking tab from engagement with said ejection port;

a finger tube enclosing said release tab, with an axis generally parallel to said long axis of said holster body, in which a user may insert a finger in order to activate said release tab to release said locking tab from said handgun ejection port; wherein said security holster provides for one handed insertion of said handgun into said security holster, with said locking tab which admits said handgun during insertion, and which moves into engagement with said ejection port for retention of said handgun until said locking tab is moved out of engagement by depression of said release tab, thereby providing said security holster with one handed insertion, one finger release of said handgun, and one handed withdrawal of said handgun after pressing said release tab and releasing said ejection port.

38. The security holster of claim 37 wherein said finger tube further includes a flared rim for facilitating insertion of said users index finger into said finger tube.

39. The security holster of claim 37 in which said locking tab is attached to a spring plate assembly by a floating connection, in which said locking tab is allowed a limited freedom of motion in its attachment to said spring plate assembly, so that if said handgun is forcefully withdrawn from said security holster without releasing said locking tab, said locking tab is pulled into engagement with a holster inner sleeve, so that force applied to withdrawing said handgun is transferred to said holster inner sleeve and is not directed to said spring plate assembly.

40. The security holster of claim 38 that further includes one or more security locks which immobilize said release tab.

41. The security holster of claim 1 in which said locking tab is configured to engage said handgun feature with an audible sound upon engagement of said locking tab with said handgun feature.

42. The security holster of claim 1 in which said holster body and finger tube are constructed of a rigid material.

43. The security holster of claim 1 which further includes one or more security locks which immobilize said release tab.

44. The security holster of claim 1 in which said release tab is configured for sliding engagement with a users finger during release of said handgun, so that said release tab may be depressed while said users finger is being withdrawn from said holster body and moving across said release tab, while said handgun is being removed.

45. A security holster for use with a handgun, the handgun having an ejection port, slide, handle, trigger, and trigger guard, wherein the holster comprises:

a holster body that includes spaced apart inner and outer substantially rigid sidewalls formed to define an inner cavity and an open top portion for receiving a handgun therein, and for removing a handgun therefrom, said holster body including a passage adjacent the handgun ejection port:

a locking tab configured to admit said handgun into said security holster body, and upon insertion of said handgun, to move through said passage into engagement with said ejection port of said handgun, thereby preventing the withdrawal of said handgun prior to release of said locking tab;

a release tab, for releasing said locking tab, which is operationally connected to said locking tab, which when depressed moves said locking tab from engagement with said ejection port;

a finger tube enclosing said release tab, in which a user may insert a finger in order to activate said release tab to release said locking tab from said handgun ejection port; wherein said security holster provides for one handed insertion of said handgun into said security holster, with said locking tab which admits said handgun during insertion, and which moves into engagement with said ejection port for retention of said handgun until said locking tab is moved out of engagement by depression of said release tab, thereby providing said security holster with one handed insertion, one finger release of said handgun, and one handed withdrawal of said handgun after pressing said release tab and releasing said ejection port.

* * * * *